US011299795B2

(12) United States Patent
Mesplont et al.

(10) Patent No.: US 11,299,795 B2
(45) Date of Patent: Apr. 12, 2022

(54) LEAD-FREE PATENTING PROCESS AND EQUIPMENT

(71) Applicant: NV Bekaert SA, Zwevegem (BE)

(72) Inventors: Christophe Mesplont, Mouvaux (FR); Tim Bruggeman, Heule (BE); Franky Beyens, Zwevegem (BE); Jan Holvoet, Deerlijk (BE); Gregory Lapeire, Wevelgem (BE)

(73) Assignee: NV BEKAERT SA, Zwevegem (BE)

( * ) Notice: Subject to any disclaimer, the term of this patent is extended or adjusted under 35 U.S.C. 154(b) by 330 days.

(21) Appl. No.: 16/473,875

(22) PCT Filed: Jan. 9, 2018

(86) PCT No.: PCT/EP2018/050388
§ 371 (c)(1),
(2) Date: Jun. 26, 2019

(87) PCT Pub. No.: WO2018/130498
PCT Pub. Date: Jul. 19, 2018

(65) Prior Publication Data

US 2019/0345578 A1 Nov. 14, 2019

(30) Foreign Application Priority Data

Jan. 12, 2017 (EP) ..... 17151117

(51) Int. Cl.
*C21D 1/64* (2006.01)
*C21D 9/573* (2006.01)

(52) U.S. Cl.
CPC ..... *C21D 9/5732* (2013.01); *C21D 1/64* (2013.01); *C21D 2211/001* (2013.01); *C21D 2211/009* (2013.01)

(58) Field of Classification Search
None
See application file for complete search history.

(56) References Cited

U.S. PATENT DOCUMENTS 6,228,188 B1 5/2001 Meersschaut et al.
7,354,493 B2 * 4/2008 Bauden ..... C21D 1/667 148/595

(Continued)

FOREIGN PATENT DOCUMENTS

CN 1814823 8/2006
EP 0 216 434 4/1987

(Continued)

OTHER PUBLICATIONS

International Search Report dated Apr. 18, 2018 in International Application No. PCT/EP2018/050388.

(Continued)

*Primary Examiner* — Scott R Kastler
(74) *Attorney, Agent, or Firm* — Wenderoth, Lind & Ponack, L.L.P.

(57) ABSTRACT

The controlled cooling of previously heated and substantially straight steel wires of diameter more than 3.5 mm to a predetermined temperature including the steps: guiding the wires along individual paths through first coolant bath having bath liquid of water and a stabilizing additive, the bath liquid and the wires create a steam film around each wire along individual paths; directing an impinging liquid immersed inside first coolant bath towards the wires over a length along individual paths to cool down the wires, the impinging liquid decreases the thickness of the steam film or destabilizes the steam film, increasing speed of cooling over the length along individual paths; guiding the wires along individual paths out of the first coolant bath to be cooled down in air; after the further cooling, guiding the wires along individual paths through second coolant bath.

11 Claims, 4 Drawing Sheets

(56) References Cited

U.S. PATENT DOCUMENTS

| | | | | |
|---|---|---|---|---|
| 8,506,878 | B2 | 8/2013 | Tyl | |
| 2015/0361536 | A1 | 12/2015 | Mesplont et al. | |
| 2019/0345578 | A1* | 11/2019 | Mesplont ..... | C21D 1/64 |

FOREIGN PATENT DOCUMENTS

| | | |
|---|---|---|
| EP | 0 524 689 | 1/1993 |
| GB | 1 276 738 | 6/1972 |
| WO | 2007/023696 | 3/2007 |
| WO | 2014/118089 | 8/2014 |

OTHER PUBLICATIONS

Written Opinion of the International Searching Authority dated Apr. 18, 2018 in International Application No. PCT/EP2018/050388.

* cited by examiner

LEAD-FREE PATENTING PROCESS AND EQUIPMENT

TECHNICAL FIELD

The present invention relates to a method and equipment for lead-free patenting of steel wires.

BACKGROUND ART

Heat treatment of steel wires usually plays an important role in the production process. The first step in wire-making starts with drawing a wire rod to a desired intermediate diameter. At this stage of work-hardening the drawn wires are heat treated to pearlite by a patenting process to enable further plastic deformation. Subsequently, the patented steel wires are drawn to a smaller size, either a second intermediate size or a final diameter. Patenting involves heating carbon steel wires into the austenitic phase, generally above 800° C. and then cooling the wires to a chosen temperature held for a sufficient period for generally isothermal decomposition of the austenite to be completed. The temperature is usually in the region between 500° C. and 680° C., with the intention being generally to provide a fine pearlite structure.

Steel wire rod made by hot rolling from ingots or billets is applied to practical use in the rolled state after having been subjected to a controlled cooling. In order to cool the high carbon rod immediately after having been hot-rolled to have an excellent cold-workability, GB1276738 described to dip the high carbon rod into a warm water bath. The method of heat-treating a steel wire rod with a wire rod diameter ranging between 5.5 mm and 6.5 mm disclosed in this document comprises dipping the wire rod maintained at a temperature from 600° C. to 1100° C. into a warm water bath containing a surface active agent. The water is held at a temperature higher than 45° C. thus generating a steam film uniformly on the wire rod surface and thereby controlling the cooling velocity of the wire rod. The essential point of this heat-treating method is to generate the steam film uniformly on the wire rod surface and to keep this state for some period of time until pearlite transformation has finished. Such a method has various merits when used in the direct cooling of hot rolled rods transported in spiral coils on a horizontal conveyor. This method has been regarded as being less suitable or unreliable for treatment of wires with other diameters.

WO2007/023696 relates to a direct heat treatment method of a loose coil-like rolled wire rod having a diameter more than 11.0 mm. The coil-like rolled wire rod is cooled by immersing them into refrigerant or exposing them to refrigerant flow.

For the heat treatment of drawn wires having a desired intermediate diameter which can vary from 1.5 to 5.0 mm, EP0216434 discloses another method of controlled cooling of steel wire previously heated to austenite temperature: the wire is transported continuously through a coolant bath containing substantially pure water of at least 80° C. and is immersed in the bath to effect a cooling to pearlite without producing martensite or bainite. The wire is subjected to uniform and stable film-boiled cooling along its entire immersion length by contacting the wire with a continuous non-turbulent flow of substantially pure water. The water patented wires feature a sufficiently uniform pearlitic microstructure with excellent drawability records.

EP0524689A1 discloses a process of patenting at least one steel wire with a diameter less than 2.8 mm. The cooling is alternatingly done by film boiling in water during one or more water cooling periods and in air during one or more air cooling periods. A water cooling period immediately follows an air cooling period and vice versa. The speed of cooling in water is high, while the speed of cooling in air is much lower. The high speed of cooling in water poses a serious risk for wires with a diameter less than 2.8 mm. Cooling in air in between cooling in water sections is performed in order to slow down the cooling of the steel wires. The number of the water cooling periods, the number of the air cooling periods and the length of each water cooling period are so chosen so as to avoid the formation of martensite or bainite.

WO2014/118089A1 entitled "Forced water cooling of thick steel wires" discloses a forced cooling process on straight steel wires having a diameter larger than 5 mm. An impinging liquid immersed inside a coolant bath is directed to the steel wire to accelerate the cooling speed of the heated steel wire. This "forced" cooling zone in the coolant bath is followed by a cooling zone in which an undisturbed (this means without impinging liquid on the boiling film around the wire) boiling film cools the wires further.

The patenting process, i.e. the cooling or transformation step, is very critical and a lot of prior attempts as above have been made for the purpose of affecting a cooling-transformation of austenitized steel wires to pearlite. However, the resulted steel wires may still show a variation in properties such as inconsistent drawability and frequently unexpected brittle behavior because of numerous undesirable metallic structures. The exact metallic structure of the patented wire not only determines the absence or presence of wire fractures during the subsequent wire drawing but also determines to a large extent the mechanical properties of the wire at its final diameter. Transformation conditions must be such that martensite or bainite are avoided even at very local spots on the steel wire surface. On the other hand, the metallic structure of the patented steel wire must not be too soft, i.e. it must not present too coarse a pearlite structure or too great a quantity of ferrite, since such a metallic structure would never yield the desired ultimate tensile strength of the steel wire. A reliable and cost effective patenting process, wherein the metallic structure and the tensile strength of the steel wires can be well controlled, is still demanded for steel wires, especially for steel wires of higher diameter.

DISCLOSURE OF INVENTION

The object of the invention is to provide a process for patenting steel wires with diameter higher than 3.5 mm that is more stable over time. It is another object of the invention to obtain patented steel wires larger than 3.5 mm diameter with a proper metallographic microstructure, i.e. a fine pearlite structure without any martensitic or bainitic spots. It is still another object of the present invention to provide a process that is suitable for finetuning the microstructure and the tensile properties of the multiple steel wires having different diameters and steel compositions.

The first aspect of the invention is a method of controlled cooling of one or multiple previously heated and substantially straight steel wire/wires to a predetermined temperature range. The previously heated and substantially straight steel wires have a diameter which is more than 3.5 mm. The method comprises the steps of a) Guiding the previously heated and substantially straight steel wire/wires along individual path/paths through one or through multiple first coolant bath/baths. The first coolant bath/baths comprise(s) a bath liquid. The bath liquid comprises water and a stabilizing additive. Preferably, the bath liquid has a temperature of more than 80° C. The bath liquid and the multiple previously heated and substantially straight steel wires create a steam film around each steel wire itself along each individual path.

b) Directing an impinging liquid immersed inside the first coolant bath/baths towards the previously heated and substantially straight steel wire/wires over a certain length L along individual path/paths, to cool down the previously heated and substantially straight steel wire/wires. The impinging liquid decreases the thickness of the steam film or destabilizes the steam film, thereby increasing the speed of cooling over the length L along individual path/paths.

c) Guiding the previously heated and substantially straight steel wire/wires along individual path/paths out of the first coolant bath/baths to be further cooled down in air.

d) After the further cooling in air, guiding the previously heated, substantially straight steel wire/wires along individual path/paths through one or multiple second coolant bath/baths.

In the method, the substantially straight steel wire/wires are subjected to a cooling transformation from austenite to pearlite.

Steel wires of diameter higher than 3.5 mm need to be cooled initially fast in patenting. Such fast cooling is performed in the inventive method by the forced cooling in the first coolant bath. As in WO2014/118089A1, forced cooling is achieved by directing an impinging liquid immersed inside a coolant bath towards the previously heated and substantially straight steel wires. The impinging liquid decreases the thickness of the steam film or destabilizes the steam film, thereby increasing the speed of cooling. As in WO2014/118089A1, the inventive method includes (and requires) further—slower—cooling of the steel wire by an undisturbed steam film around the steel wires; this can be called an unforced cooling wherein the wires run through liquid. In the inventive method, the steel wires run through air between the first coolant bath (in which forced cooling is applied to the steel wires) and the second coolant bath (in which cooling of the wires is performed by an undisturbed steam film around the steel wire, thus by an unforced cooling). Thanks to the air gap in the inventive method, the turbulence created in the forced cooling does not—unlike in WO2014/118089A1—affect the unforced cooling (this is the cooling in liquid where the steam film around the wires is not disturbed). In WO2014/118089A1, the turbulence in the coolant bath will—unintentionally—affect the steam film in an uncontrolled way in the unforced cooling zone. During the transformation process to pearlite, an isothermal transformation is preferred, reason why the rate of cooling needs to be precise. When the steam film around the steel wires in unforced cooling zone is affected in an uncontrolled way, it means that the rate of cooling changes. Therefore, the conditions of cooling will not be stable in the second cooling zone, and the quality of the patented wire will not be constant over time, and can even be unacceptable. Therefore, the inventive method has the benefit that a more reliable and more constant transformation of the steel wires from austenite to pearlite is obtained for diameters larger than 3.5 mm.

The invention focusses on a fast initial cooling—thanks to the forced cooling in the first coolant bath—and a stable transformation process thanks to the provision of the air gap that prevents turbulence in the second liquid coolant bath. Although EP0524689A1 also provides air cooling between two sections with film boiling, the reason for the air cooling is totally different, as the air cooling in EP0524689A1 is provided to reduce the speed of cooling, as otherwise the steel wires would continuously be transformed to martensite instead of to pearlite.

In the present invention, the controlled cooling method relates to one or multiple substantially straight lines of steel wires. These steel wires pass through the first coolant bath along individual paths. In other words, the paths in the first coolant bath are substantially straight. Therefore, the paths of each steel wire are well defined. Normally, the first coolant bath may have a rectangular shape and the paths of steel wires are substantially parallel to one side of the rectangular shaped first coolant bath. This makes it possible to direct an impinging liquid immersed inside the first coolant bath towards the steam film on the steel wires. For instance, the impinging liquid can come from below the steel wires, towards the steel wires (or the steam film) and along the individual paths. Thus, the steam film can be destabilized or the thickness of the steam film is decreased.

According to the present invention, the previously heated steel wire/wires is/are subjected to a controlled cooling-transformation treatment from austenite to pearlite. The steel wire/wires is/are previously heated above austenitizing temperature and preferably cooled at a predetermined temperature range from 400° C. to 650° C. in order to allow transformation from austenite to pearlite, more preferably at the temperature of about 580° C.

The first coolant bath/baths comprise(s) a bath liquid. The bath liquid comprises water and a stabilizing additive. The stabilizing additives are provided to increase the stability of the vapor/steam film around the steel wires. The stabilizing additives may comprise surface active agents such as soap, stabilizing polymers such as polyvinyl pyrrolidone, polyvinyl alcohol and/or polymer quenchants such as alkalipolyacrylates or sodium polyacrylate. The additives are used to increase the thickness and stability of the vapor film around the steel wire.

Preferably, the temperature of the bath liquid in the first coolant bath is set between 80° C. to 100° C. The temperature of the bath liquid of the first coolant bath is preferably more than 80° C., e.g. 85° C., most preferably above 90° C., e.g. around 95° C. The higher the water temperature, the higher the stability of the vapor film around the steel wire.

Preferably, the impinging liquid has the same chemical composition as the bath liquid of the first coolant bath.

Preferably, the composition of the bath liquid of the second coolant bath(s) is the same as the composition of the bath liquid of the first coolant bath(s). More preferably, the bath liquid of the first coolant bath(s) and of the second coolant bath(s) are continuously circulated—by means of a circulation pump—wherein a common intermediate storage recipient is used for bath liquid taken from and recirculated to the first coolant bath(s) and the second coolant bath(s). This way, the homogeneity of the composition of the bath liquids in the first coolant bath(s) and in the second coolant bath(s) is improved, resulting in a more stable cooling system.

Preferably, the intensity of the impinging liquids can be or is individually set and/or controlled for each individual steel wire or for subsets of the plurality of steel wires. By setting and/or controlling the intensity of the impinging liquids, the intensity of disturbing the steam film around the steel wires is modified, thereby modifying the rate of cooling of the steel wires. This way, parameters can be set so as to cool and transform each wire optimally, also improving the reliability of the transformation process. The intensity of the impinging liquids can e.g. be controlled by flow rate control towards the jets producing the impinging liquids; to this end an appropriate flow control system can be used. In the present invention, preferably the cooling rate is adjusted by tuning the coolant flow by means of the pressure in front of the jets. More preferably, the cooling rate of each steel wire is individually controlled by a separate control actuator such that different cooling scheme and desirable tensile strength can be achieved for different wires.

According to the present invention, the cooling of individual steel wire can be well controlled such that the location where transformation from austenite to pearlite occurs, can be varied. By adjusting the cooling scheme, e.g. by selecting the flow rate to the impinging jets providing the impinging liquids in the first coolant bath, the transformation of individual steel wire can occur in the first coolant bath, in the air gap region between the first coolant bath and the second coolant bath, or in second coolant bath. The tensile strength of steel wires having different diameters and steel compositions can thus be finetuned.

In a preferred method, the cooling transformation from austenite to pearlite starts substantially when the previously heated and substantially straight steel wire is cooled down in air between the first coolant bath and the second coolant bath.

The flow rate of the impinging liquid preferably needs to be carefully tuned in order to have a desired destabilization of steam film or reduction in thickness of steam film. Instead of using a separated system with cold water and impinging liquid as in many cooling or patenting installations, preferably according to the present invention the chemical composition of the impinging liquid and the liquid in the first coolant bath is the same. This brings two major advantages: one is much lower cost of installation (use of the same tank and cooling liquid); the other is reducing the temperature gradient between the core and the surface of the wire (no direct contact with cold water, a more stable steam film is obtained), contributing to a more homogeneous patented structure.

In a preferred embodiment, the length of the first coolant bath and/or of the second coolant bath/baths is/are adjustable. This way, further finetuning capacity is provided into the inventive method to optimize and stabilize the microstructure of the patented steel wires.

In preferred embodiments, partitioning walls are provided separating steel wires in the first coolant bath along the full length of the steel wires along which the steam film around the steel wires is affected by the impinging fluids, such that impinging fluids onto a first steel wire do not affect the steam film around a second steel wire. It also involves that the intensity of the impinging liquids can be set for individual steel wires without being affected by the intensity of impinging liquids from neighboring steel wires. Such embodiments provide further synergistic improvements in the quality and stability of patenting the steel wires, especially when steel wires of different diameters and/or of different alloys are patented simultaneously.

In preferred embodiments, the speed of cooling over the length L along each individual path is controlled by a flow rate of the impinging liquid.

In preferred embodiments, the first coolant bath(s) has/have a fixed length.

Preferably, the impinging liquid is immersed below each of the previously heated and substantially straight steel wire itself along each individual path; or the impinging liquid is immersed partially below some of the multiple previously heated and substantially straight steel wires along their individual paths.

Preferably, the first coolant bath is of the overflow-type. More preferably, impinging liquid is provided by a plurality of jets from holes immersed inside the coolant bath below the steel wire itself along each individual path. An advantage of having the jets below the steel wires is that one can easily reach and arrange the steel wires without being hindered by the jets.

A plurality of jets from the immersed holes are preferably adapted to rectilinearly direct towards the steam films, e.g. perpendicular to the wire or wires so as to have an effective impact on the steam films—destabilize the steam films, or decrease the thickness of the steam films, further to increase the cooling speed of the steel wires.

Preferably, the impinging liquids are continuously recirculated and controlled by flow rate control system; e.g. using pumps. More preferably, one or a plurality of sensors are provided to measure the magnetic response of one or more than one of the steel wires; and to provide feedback to adapt in a closed loop control the impinging liquids in the first coolant baths. This would be much more difficult if not impossible with the concept using variable forced cooling length as disclosed in WO2014/118089A1.

The steel wires subjected to the controlled cooling according to the invention can have a diameter in a range from 3.5 mm to 20 mm. For example, the diameter of the steel wires ranges from 3.5 mm to 20 mm or from 6.5 mm to 13.5 mm.

The second aspect of the invention is equipment for controlled cooling of one or multiple previously heated steel wires to a predetermined temperature range. The equipment comprises a) first coolant bath (s). The first coolant bath(s) is/are provided for containing a bath liquid comprising water and a stabilizing additive, e.g. a stabilizing polymer. Preferably, means are provided to adjust the bath liquid temperature; more preferably to a temperature of more than 80° C.;

b) one or a plurality of impinging liquid generator(s) immersed inside the first coolant bath(s), being adapted to jet impinging liquid towards each steel wire along individual path;

c) second coolant bath(s). The second coolant bath(s) is/are provided for containing bath liquid comprising water and a stabilizing additive, e.g. a stabilizing polymer. Preferably, means are provided to adjust the bath liquid temperature, more preferably to a temperature of more than 80° C. The second coolant bath(s) are separated from the first coolant bath(s) with an air gap in-between the first coolant bath(s) and the second coolant bath(s). Preferably, the air gap has a length between 0.1 and 2 m;

d) guiding means for guiding one or multiple previously heated steel wires continuously along individual paths subsequently through the first coolant bath(s), the air gap and the second coolant bath(s). Preferably, the equipment is provided to perform a method as in any embodiment of the first aspect of the invention.

Equipment according to the invention has the advantage of low investment costs and low operating costs. It is quite easy to adapt conventional water air patenting equipment to forced water cooling equipment according to this invention. The equipment according to this invention is not only applied to cool a plurality of previously heated steel wires each having a same diameter; but also a plurality of previously heated steel wires with different diameters, which can be realized by means of adjusting the flow rate individually in the first coolant bath and/or by adjusting the length of the second coolant bath along each individual path.

Preferably, the first coolant baths, the impinging liquid generators and the air gaps have a fixed length along each individual path.

Preferably, the length of the first coolant bath and/or of the second coolant baths is adjustable.

Preferably, the equipment comprises means for controlling the intensity of the one or the plurality of impinging liquid generator(s). To this end, a flow rate control system—preferably outside the first coolant bath—can be provided. A pump with flow rate control can be used to this end. Alternatively, the flow rate can be controlled by means of one or a plurality of valves or orifices.

Preferably, the first coolant bath(s) is/are of the overflow type.

Preferably, the second coolant bath(s) is/are of the overflow type.

BRIEF DESCRIPTION OF FIGURES IN THE DRAWINGS

FIG. 1 shows a preferred water air patenting concept according to the present invention.

FIG. 2 gives schematic representation of carrying out a cooling process according to the present invention;

MODE(S) FOR CARRYING OUT THE INVENTION

Figure 1:
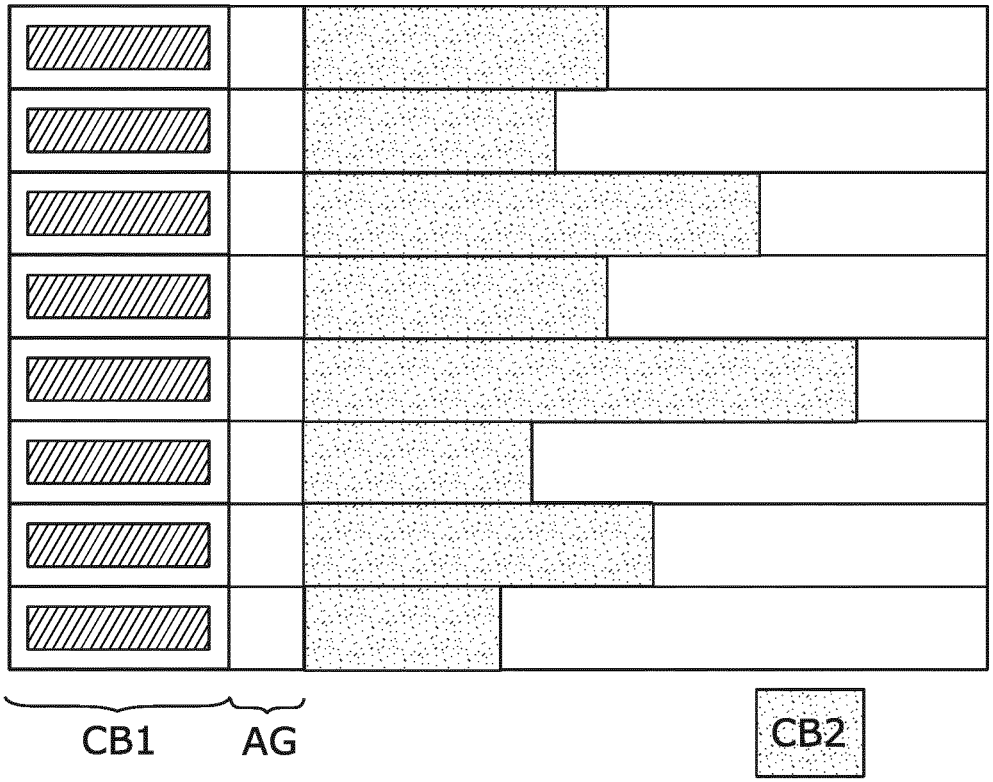

A preferred water air patenting cooling method and equipment according to the present invention is schematically shown in FIG. 1. The cooling length with impinging liquid in the first coolant bath (CB1) is fixed and the cooling rate is adjusted by tuning the coolant flow by means of the pressure in front of the jets. A short air gap (AG) is provided to separate the first coolant bath (CB1) and the second coolant bath (CB2). The second coolant bath (CB2) is adjustable in length. The length of first coolant bath, the flow rate of the jets for forced cooling and the length of air gap region are so chosen as to avoid the formation of martensite or bainite.

Preferably as shown in FIG. 1, the first coolant bath is provided with partitioning walls separating steel wires in the first coolant bath along the length of the steel wires along which the steam film around the steel wires is affected by the impinging liquid, such that impinging liquids onto a first steel wire do not affect the steam film around a second steel wire. Preferably, as shown in FIG. 1, the first coolant baths, the impinging liquid generators and the air gaps along each individual path have a fixed length and the length of the second coolant baths is adjustable.

Figure 2:
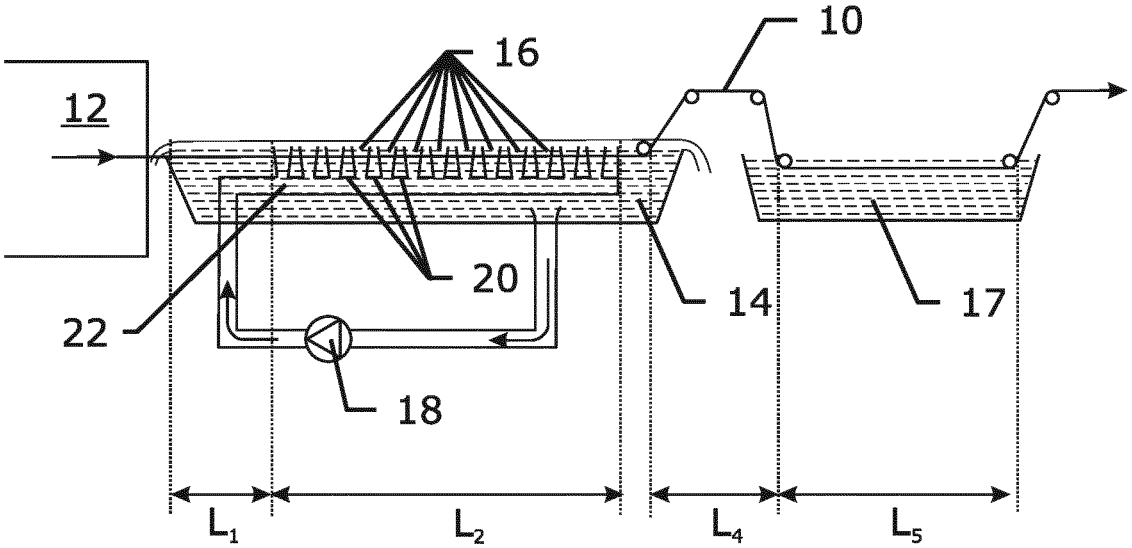

FIG. 2 schematically illustrates a controlled cooling of one substantially straight steel wire according to the present invention. As shown in FIG. 2, a steel wire 10 is led out of a furnace 12 having a temperature T of about 1000° C. The wire running speed can be adjusted according to the diameter of the wire, e.g. about 20 m/min. A first coolant bath 14 of an overflow-type is situated immediately downstream the furnace 12. A plurality of jets 16 from the holes 20 of a hollow plate (i.e. perforated plate) 22 immersed inside the first coolant bath are forming an impinging liquid, whose flow rate is controlled by a circulation pump and control system 18 outside the first coolant bath. The impinging liquid under pressure from the holes 20 is jetting towards the steel wire 10. As illustrated in FIG. 2, the first length $L_1$ is the distance away from the exit of furnace 12 to the impinging liquid. The second length $L_2$ indicates the length used for forced coolant cooling process—forced coolant cooling length—in the first coolant bath. The steel wire 10 is then led out of the first coolant bath and subjected to an air gap region with a length of $L_4$ as indicated in FIG. 2. Thereafter, the steel wire 10 is guided into a second coolant bath 17 to further cool down. The immersion length of the steel wire 10 in the second coolant bath 17 is indicated as $L_5$. The length $L_5$ can be variable depending on the diameter and the desired tensile strength of the steel wire 10.

Figure 3:
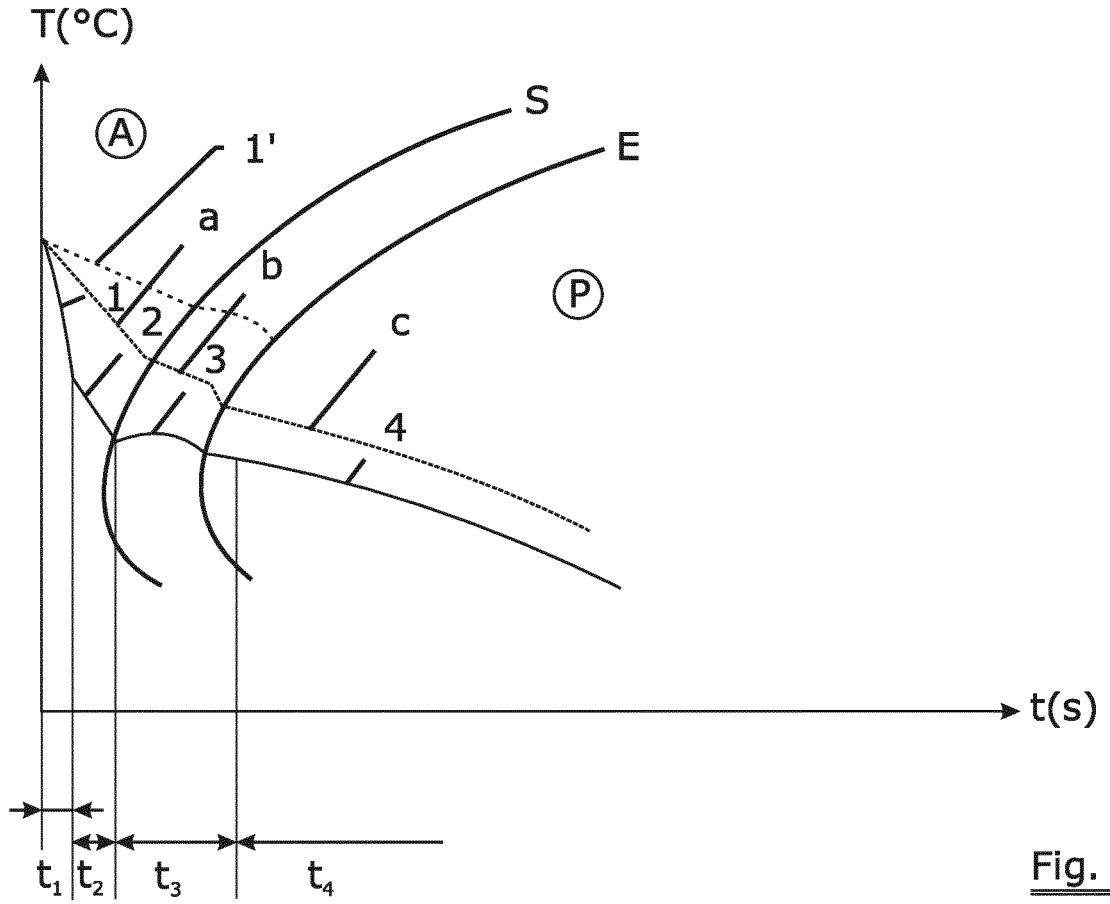
FIG. 3 shows cooling curves of heated steel wires according to different routines.

FIG. 3 illustrates different cooling curves in a so-called TTT diagram (Temperature-Time-Transformation). Time is presented in abscissa and temperature forms the ordinate. S is the curve which designates the start of the transformation from austenite (A) to pearlite (P), E is the curve which designates the end of this transformation. As an example, a steel wire which is cooled by film boiling in an overflow water bath follows the dotted lines of cooling curve 1'. The dotted line of cooling curve 1' does not reach the "nose" of the curve S and E. Curves 1-4 illustrate the process described in WO2014118089, wherein curve 1 illustrates the cooling progress in the period of the forced water cooling treatment, curve 2 shows the next stage in a "soft" conventional water air patenting process, curve 3 is the cooling curve during transformation and curve 4 shows further cooling in the post-transformation stage occurs in the air. In comparison with the above two situations, an example of a cooling curve according to the present invention is indicated by curves a-c. Curve a illustrates the cooling occurred in the first coolant bath, where the cooling rate is adjusted by the flow rate, and in the air gap followed by the first coolant bath. Curve b is the cooling curve during transformation and it can be occurred in the second coolant bath without disrupting the steam film. Curve c is the cooling curve showing the post-transformation in the air. The cooling curves a-c can be modified by changing the cooling scheme of steel wire.

Figure 4:
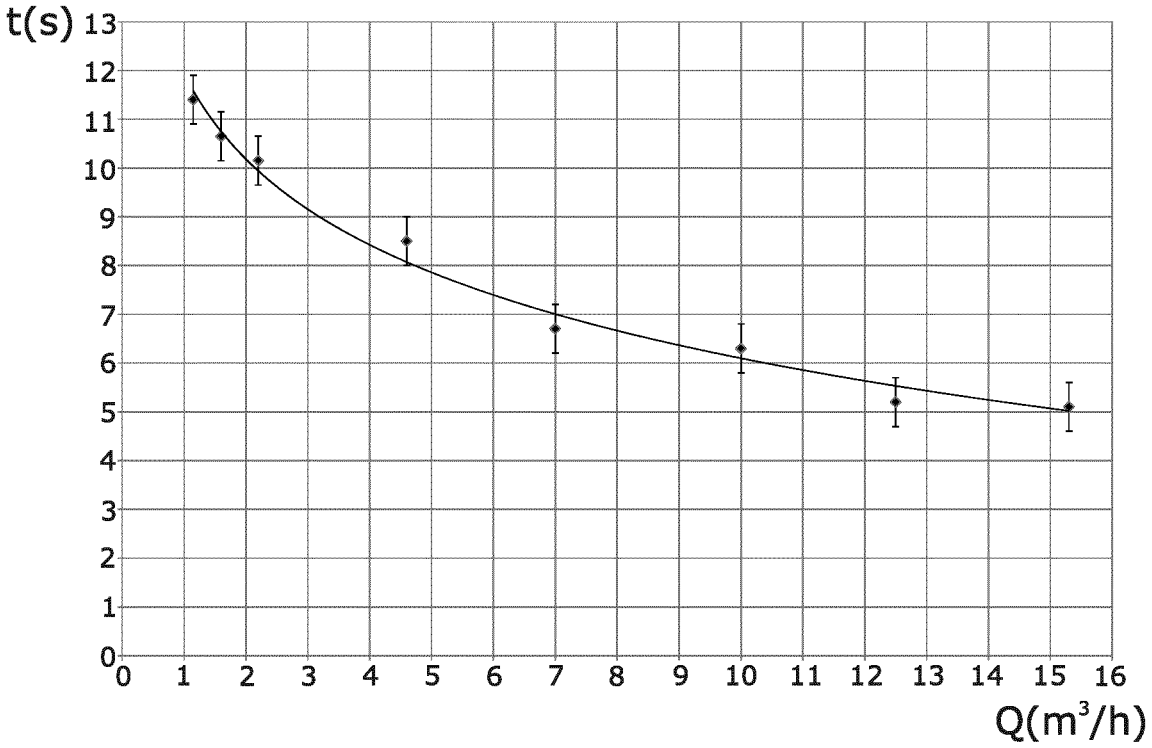
FIG. 4 illustrates the influence of flow rate to the cooling speed.

The cooling rate of steel wires having different diameter can be well tuned by adjusting the flow rate. Tests on cooling time vs. flow rate have been performed by a probe with 6 mm diameter cooled down from 750° C. to 500° C. The tests are carried out at several flow rates in a range from 1 $m^3/h$ to 16 $m^3/h$ and the results are shown in FIG. 4. An increase of flow rate from 1.15 $m^3/h$ to 15.3 $m^3/h$ can reduce the cooling time from 11.4 second to 5.1 second. It demonstrates that an increase of the flow rate can significantly reduce the cooling time, i.e. accelerate the cooling speed.

By adjusting the flow rate, the starting point of the transformation from austenite to pearlite of the steel wire can be controlled. The transformation can start in the first coolant bath (CB1), in the air gap region (AG), or in the second coolant bath (CB2).

Figure 5:
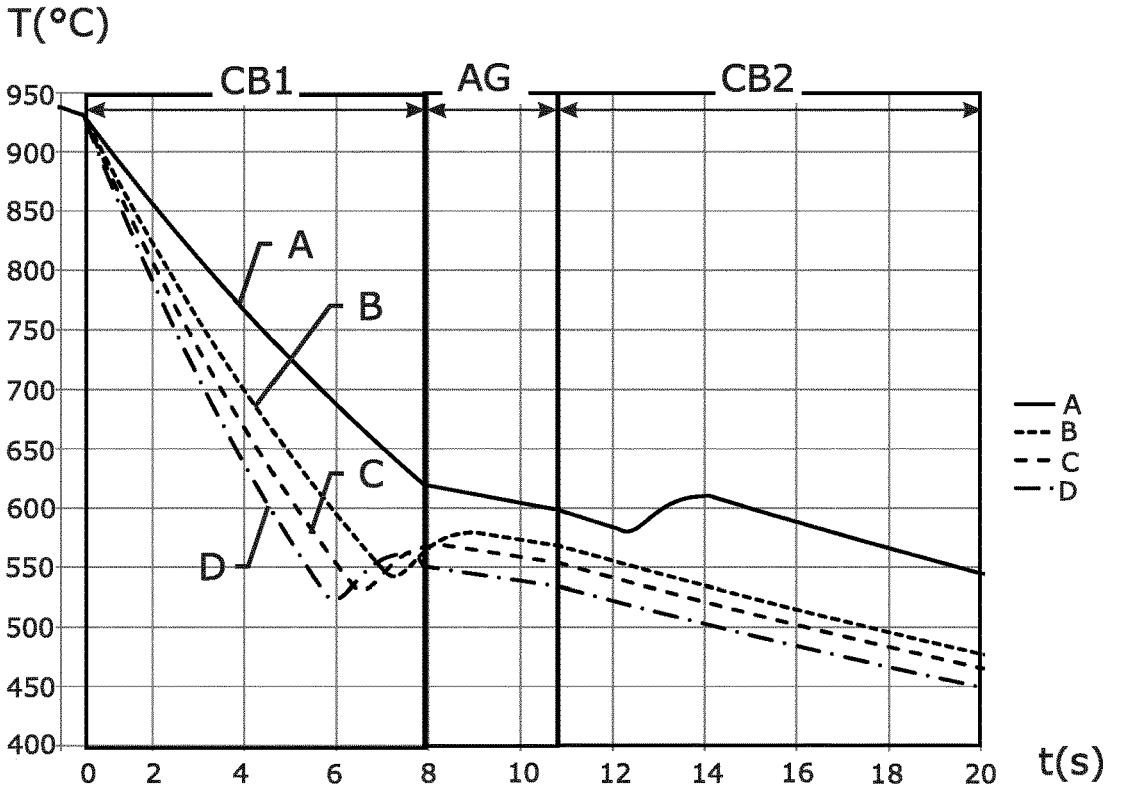
FIG. 5 illustrates the cooling curves of steel wires subjected to a forced cooling at different flow rate according to an example of the present invention.

As an example shown in FIG. 5, a steel wire having a diameter of 6.5 mm and a carbon content of 0.62 wt % is cooled from 950° C. The heated steel wire is quickly guided from the furnace into the first coolant bath (CB1), subsequently subjected to an air gap region (AG), and followed by a second coolant bath (CB2). The temperature vs. cooling time of the steel wire at a different flow rate of 3 $m^3/h$, 9 $m^3/h$, 12 $m^3/h$ and 15 $m^3/h$ are respectively measured and the cooling curves are respectively shown as curve A, B, C and D in FIG. 5. Herein, the same cooling equipment installation is applied except the flow rates are different. The length for the forcing cooling is 160 cm, for the air gap region is 65 cm and for the second coolant bath is 200 cm. When the flow rate is set at 3 $m^3/h$, as shown in curve A, the transformation starts at a temperature of about 580° C. in the second coolant bath. Using higher flow rate, i.e. at 9 $m^3/h$, 12 $m^3/h$ and 15 $m^3/h$, the transformation starts in the first coolant bath at a temperature between 500° C. and 550° C. and continues in the air gap region.

Figure 6:
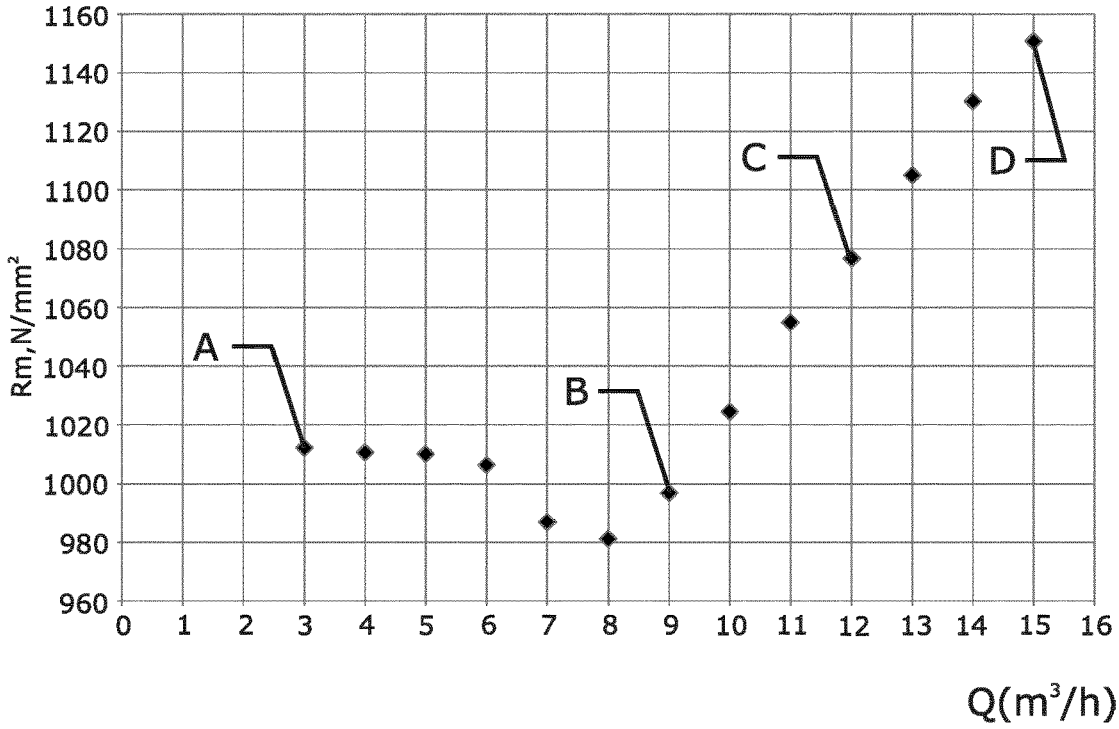
FIG. 6 illustrates the tensile strength of steel wires subjected to a forced cooling at different flow rate according to an example of the present invention.

Consequently, the cooling rate and cooling process determine the microstructure of the cooled steel wires and thus the ultimate tensile strength of the steel wire. The tensile strength of the steel wires having a diameter of 6.5 mm and a carbon content of 0.62% by weight as a function of flow rates are illustrated in FIG. 6. The steel wire cooled at a forced cooling rate of 3 $m^3/h$, 9 $m^3/h$, 12 $m^3/h$ and 15 $m^3/h$ respectively has a tensile strength (Rm) of 1012 $N/mm^2$, 997 $N/mm^2$, 1077 $N/mm^2$ and 1151 $N/mm^2$. Thus, the tensile strength of the steel wires can be adjusted by selecting the flow rate during the forced cooling in the first coolant bath.

Figure 7:
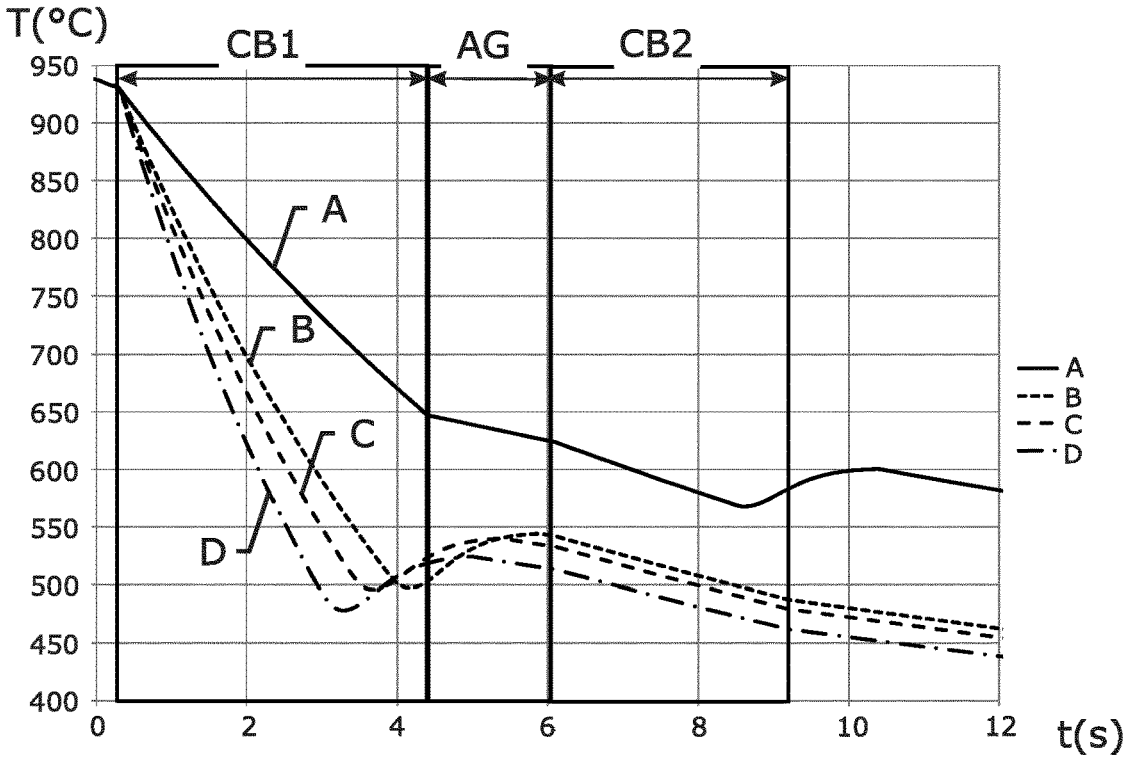
FIG. 7 illustrates the cooling curves of steel wires subjected to a forced cooling at different flow rate according to another example of the present invention.

Another example is shown in FIG. 7: a steel wire having a diameter of 3.6 mm and a carbon content of 0.70% by weight is cooled from 950° C. The heated steel wire is quickly guided from the furnace into the first coolant bath (CB1), subsequently subjected to an air gap region (AG), and followed by a second coolant bath (CB2). The temperature vs. cooling time of the steel wire at a different flow rate of 3 $m^3/h$, 9 $m^3/h$, 11 $m^3/h$ and 14 $m^3/h$ are respectively measured and the cooling curves are respectively shown as curve A, B, C and D in FIG. 7. Herein, the same cooling equipment installation is applied except the flow rates are different. The length for the forced cooling is 160 cm, for the air gap region is 65 cm and for the second coolant bath is 120 cm. When the rate is set at 3 $m^3/h$, as shown in curve A, the transformation starts at a temperature slightly higher than 560° C. in the second coolant bath. Using higher flow rate, i.e. at 9 $m^3/h$, 11 $m^3/h$ and 14 $m^3/h$, the transformation starts in the first coolant bath at a temperature around 500° C. and continues in the air gap region.

Figure 8:
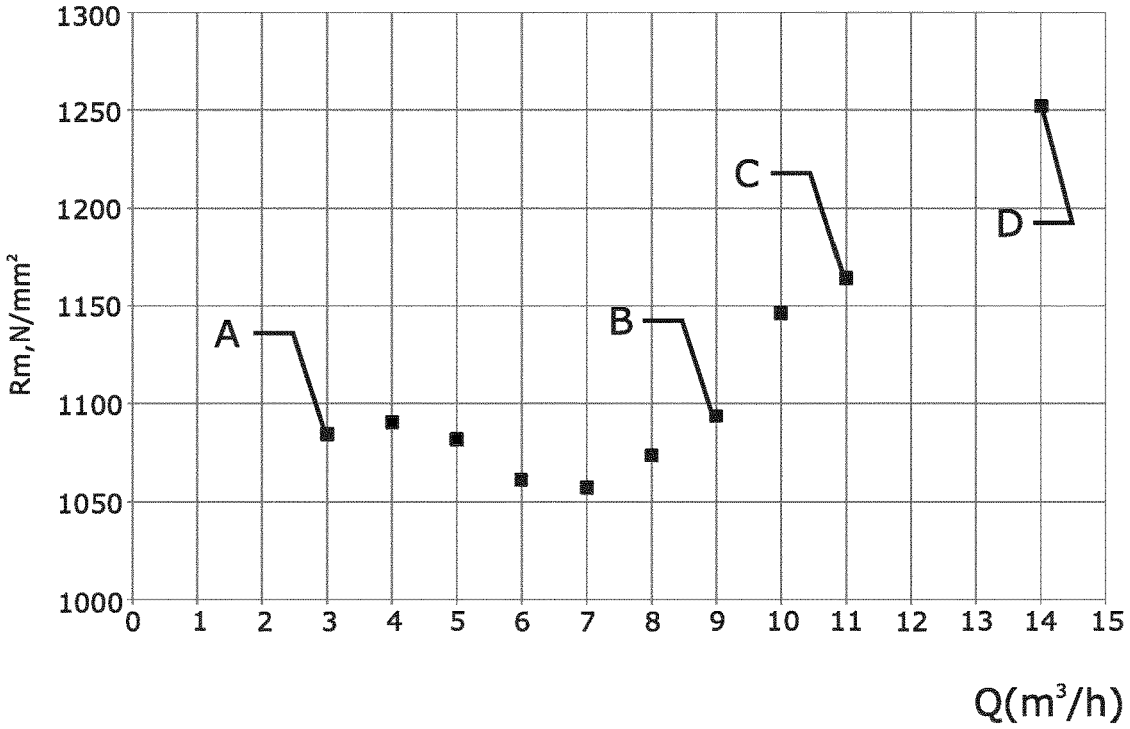
FIG. 8 illustrates the tensile strength of steel wires subjected to a forced cooling at different flow rate according to another example of the present invention.

Consequently, the cooling rate and cooling process determine the microstructure of the cooled steel wires and thus the ultimate tensile strength of the steel wire. The tensile strength of the steel wires having a diameter of 3.6 mm and a carbon content of 0.70 wt % as a function of flow rates are illustrated in FIG. 8. The steel wire cooled at a forced cooling rate of 3 $m^3/h$, 9 $m^3/h$, 11 $m^3/h$ and 14 $m^3/h$ respectively has a tensile strength (Rm) of 1084 $N/mm^2$, 1094 $N/mm^2$, 1164 $N/mm^2$ and 1252 $N/mm^2$. It demonstrates that the tensile strength of the steel wires can be adjusted by selecting the flow rate during the forced cooling in the first coolant bath.

The invention claimed is:

1. A method of controlled cooling of one or multiple previously heated and substantially straight steel wire/wires to a predetermined temperature range, the previously heated and substantially straight steel wires having a diameter which is more than 3.5 mm and less than 20 mm, the method comprises the steps of:

a) guiding the previously heated and substantially straight steel wire/wires along individual path/paths through one or multiple first coolant bath/baths, the first coolant bath/baths comprises a bath liquid, wherein the bath liquid comprises water and a stabilizing additive, wherein the bath liquid and the multiple previously heated and substantially straight steel wires create a steam film around each steel wire itself along each individual path;

b) directing an impinging liquid immersed inside the first coolant bath/baths towards the previously heated and substantially straight steel wire/wires over a certain length L along individual path/paths, to cool down the previously heated and substantially straight steel wire/wires, wherein the impinging liquid decreases the thickness of the steam film or destabilizes the steam film, thereby increasing the speed of cooling over the length L along individual path/paths, c) guiding the previously heated and substantially straight steel wire/wires along individual path/paths out of the first coolant bath/baths to be further cooled down in air, d) after the further cooling in air, guiding the previously heated, substantially straight steel wire/wires along individual path/paths through one or multiple second coolant bath/baths, wherein the substantially straight steel wire/wires are subjected to a cooling transformation from austenite to pearlite.

2. The method according to claim 1, wherein the impinging liquid is immersed below each of the previously heated and substantially straight steel wire itself along each individual path; or wherein the impinging liquid is immersed partially below some of the multiple previously heated and substantially straight steel wires along their individual paths.

3. The method according to claim 1, wherein the length of the first coolant bath and/or of the second coolant bath/baths are adjustable.

4. The method according to claim 1, wherein the first coolant bath is provided with partitioning walls separating steel wires in the first coolant bath along the length of the steel wires along which the steam film around the steel wires is affected by the impinging liquid, such that impinging liquids onto a first steel wire do not affect the steam film around a second steel wire.

5. The method according to claim 1, wherein the intensity of the impinging liquids is individually set and/or controlled for each individual steel wire or for subsets of the plurality of steel wires.

6. The method according to claim 1, wherein the first coolant bath(s) has/have a fixed length.

7. The method according to claim 1, wherein the impinging liquid has the same chemical composition as the bath liquid of the first coolant bath.

8. The method according to claim 1, wherein the impinging liquids are continuously recirculated and controlled by a flow rate control system.

9. The method according to claim 8, wherein one or a plurality of sensors are provided to measure the magnetic response of one or more than one of the steel wires; and to provide feedback to adapt in a closed loop control the impinging liquids in the first coolant baths.

10. The method according to claim 1, wherein the cooling transformation from austenite to pearlite starts substantially when the previously heated and substantially straight steel wire is cooled down in air between the first coolant bath and the second coolant bath.

11. The method according to claim 1, wherein each of the steel wire is previously heated above austenitizing temperature and cooled down to a predetermined temperature between 400° C. and 650° C.

* * * * *